US005437565A

United States Patent [19]

Atsumi et al.

[11] Patent Number: 5,437,565

[45] Date of Patent: Aug. 1, 1995

[54] CONNECTOR

[75] Inventors: Keigo Atsumi; Eiji Saijo, both of Yokkaichi, Japan

[73] Assignee: Sumitomo Wiring Systems, Mie, Japan

[21] Appl. No.: 163,718

[22] Filed: Dec. 9, 1993

[30] Foreign Application Priority Data

Jan. 14, 1993 [JP] Japan ..... 5-003848

[51] Int. Cl.[6] ..... H01R 13/436

[52] U.S. Cl. ..... 439/752

[58] Field of Search ..... 439/595, 752

[56] References Cited

U.S. PATENT DOCUMENTS 4,867,712 9/1989 Kato et al. ..... 439/752

5,299,958 4/1994 Ohsumi ..... 439/752

*Primary Examiner*—Gary F. Paumen

*Attorney, Agent, or Firm*—Oliff & Berridge

[57] ABSTRACT

For effecting a terminal insertion operation with respect to a connector in which a retainer is disposed in a completely-retained position before inserting metal terminals, the metal terminal is inserted into a terminal receiving chamber. As a result, the metal terminal abuts against a slanting guide surface formed on the retainer. When the metal terminal is further advanced, an engagement force in the completely-retained position is released, so that the retainer is forced back to a provisionally-retained position where an engagement projection piece is retracted from the terminal receiving chamber. The retainer thus disposed in the provisionally-retained position is again pushed into the completely-retained position, thereby finishing the insertion of the metal terminal. Namely, regardless of whether the retainer is disposed in the provisionally-retained position or the completely-retained position, the terminal insertion operation can be effected merely by inserting the metal terminal into the terminal receiving chamber.

8 Claims, 4 Drawing Sheets

CONNECTOR

BACKGROUND OF THE INVENTION

This invention relates to a connector, and more particularly to a connector having an improved locking arrangement.

There is known a conventional connector as shown in FIG. 8, in which a metal terminal 3, primarily retained in a terminal receiving chamber 5 provided in a housing 1 in a direction from a front to a rear of the housing, is secondarily retained by a retainer 2 inserted into the housing I from one side of the housing. In this connector, in a provisionally-retained condition (indicated by a solid line) of the retainer 2, when the metal terminal 3 is inserted, an engagement projection 14*a* of an engagement arm 14 is engaged with the metal terminal 3 to primarily retain the metal terminal 3. When the retainer 2 is farther pushed into a completely-retained position (indicated by a dots-and-dash line) in the direction indication by the arrow in FIG. 8, an engagement projection piece 22, formed on and projected from a top of the retainer 2, is fitted in a recess 33 formed in the metal terminal 3, thereby retaining the metal terminal 3 completely or secondarily.

A number of connectors of this kind, having their respective retainers 2 held in the provisionally-retained position (FIG. 8), are put in a container box or a container bag and are transferred for a terminal insertion step. Therefore, when some external force acts on the retainer 2 during the transfer, the retainer may be urged into the completely-retained position shown in FIG. 9. In this condition, the engagement projection piece 22 is received in the terminal receiving chamber 5 and prevents the insertion of the metal terminal 3. In order to effect the terminal insertion operation with respect to such a connector, the retainer 2 must be returned to the provisionally-retained position before the metal terminal 3 can be inserted. For thus returning the retainer 2 from the completely-retained position to the provisionally-retained position, it is necessary to release the engagement in the completely-retained position, using a tool. Such a release operation has made the insertion operation inefficient.

SUMMARY OF THE INVENTION

The present invention has been made in view of the above problem, and an object of the invention is to provide a connector in which a retainer, disposed in a completely-retained position before the insertion of a metal terminal, can be easily returned to a provisionally-retained position, thereby enabling the insertion of the metal terminal.

In order to achieve the above object, a retainer has engagement projection pieces that intrude respectively into terminal receiving chambers in a completely-retained position, and a slanting guide surface is formed on a rear portion of each of the engagement projection pieces. The slanting guide surface causes the inserted metal terminal to push the retainer back to the provisionally-retained position from the completely-retained position.

With the above construction of this invention, the following effects are achieved.

For effecting the terminal insertion operation with respect to the connector in which the retainer is disposed in the completely-retained position before inserting the metal terminals, the metal terminal is first inserted into the terminal receiving chamber from a rear side thereof. As a result, the metal terminal abuts against the slanting guide surface formed on the retainer. When the metal terminal is further advanced against an engagement force exerted on the retainer in the completely-retained position, a vertical component force of a stress exerted on this slanting guide surface overcomes the engagement force exerted in the completely-retained position to release this engagement, so that the retainer is pushed back to the provisionally-retained position where the engagement projection piece is retracted from the terminal receiving chamber. As a result, the metal terminal can be inserted farther into the terminal receiving chamber. Then, when the retainer thus pushed back to the provisionally-retained position is again pushed in, the metal terminal is retained in the completely-retained position, thereby finishing the metal terminal insertion operation.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

A preferred embodiment of the present invention will now be described in detail with reference to FIGS. 1 to 7.

Figure 1:
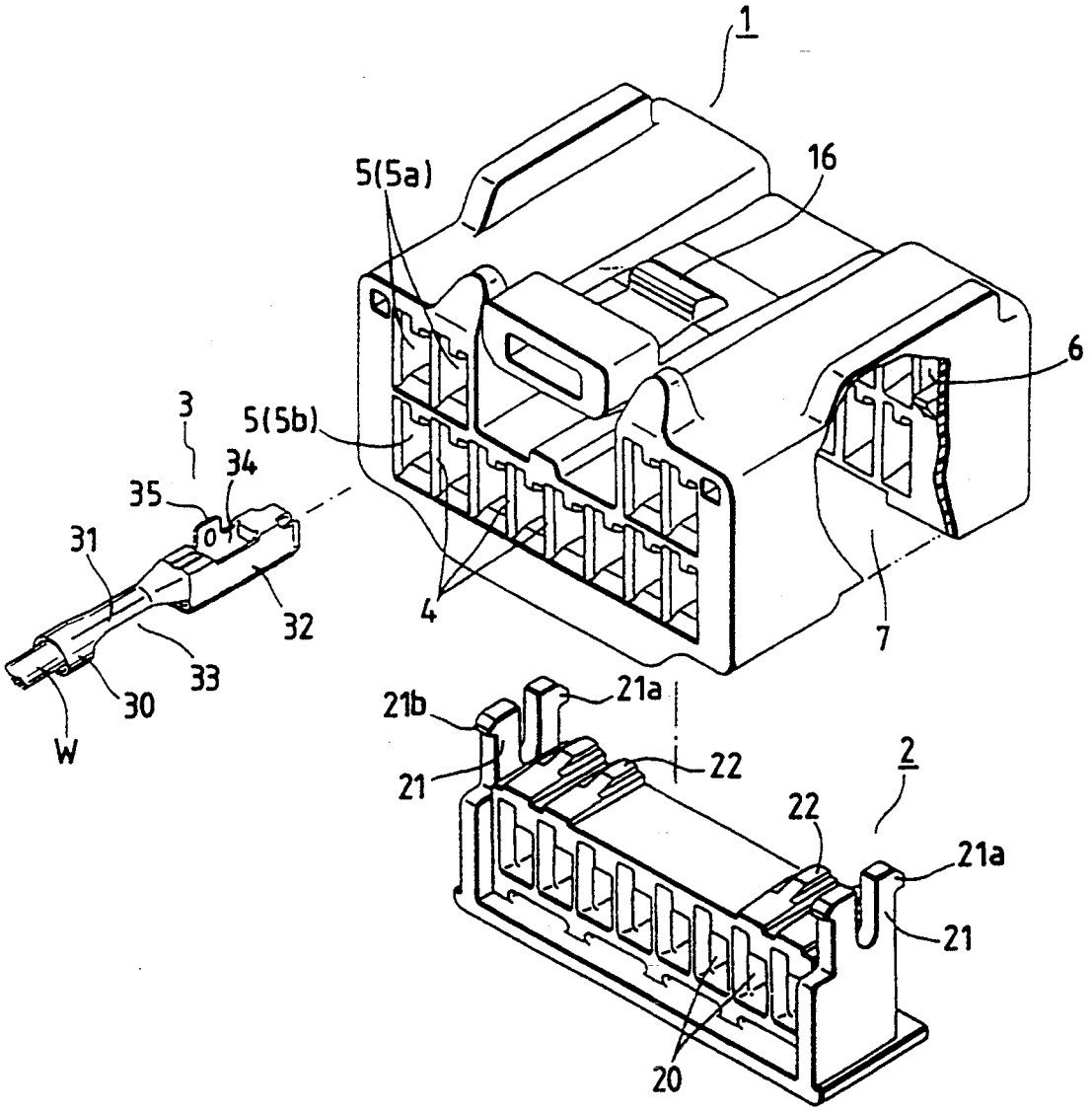
FIG. 1 is an exploded perspective view of a connector.

As shown in FIG. 1, a connector comprises a housing I of a generally rectangular parallelepiped shape and a retainer 2 separate from housing 1. A front end portion of an electric wire W is compressively connected to a metal terminal 3 to be inserted into and fixed to the housing 1.

The housing 1 has a plurality of terminal receiving chambers 5 separated by partition walls 4 from one another in a right-left direction and an upward-downward direction. In the embodiment of FIG. 1, an upper row includes four terminal receiving chambers 5*a*, two provided at a right side portion and two provided at a left side portion. A lower row includes eight terminal receiving chambers 5*b*. Slit-like engagement grooves 6 for retaining a retainer 2 relative to the housing 1 are provided respectively on opposite sides of the group of terminal receiving chambers 5 and are formed by the partition walls 4. A retainer insertion hole 7 is formed centrally in one side (bottom side in FIG. 1) of the housing 1 and divides the partition walls 4 into front portions and rear portions. The retainer 2 can be inserted into this retainer insertion hole.

Figure 2:
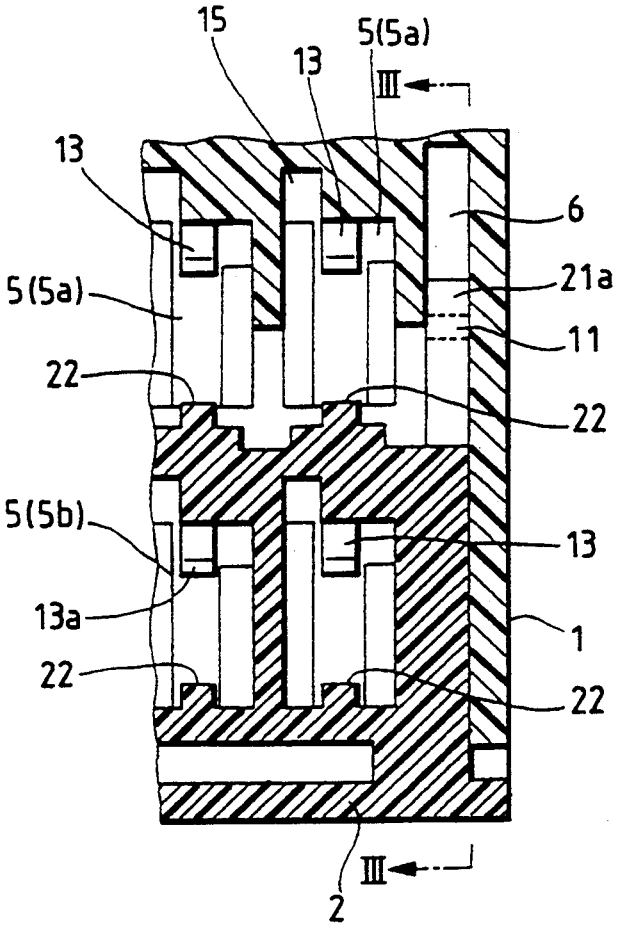
FIG. 2 is a fragmentary cross-sectional view in a provisionally-retained position.
Figure 3:
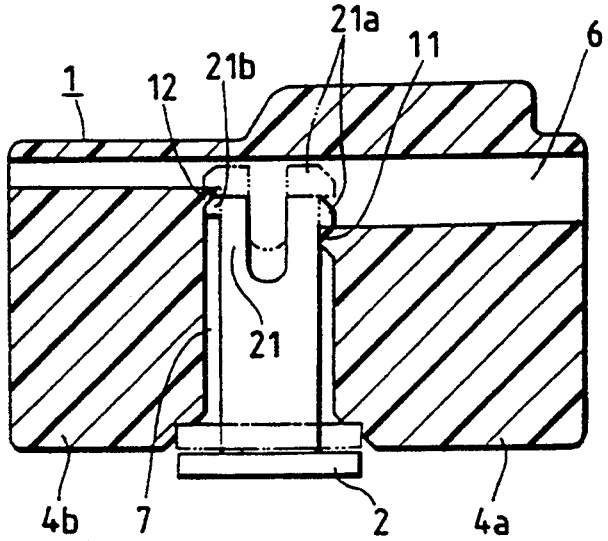
FIG. 3 is a cross-sectional view taken along the line III—III of FIG. 2.

In each of the engagement grooves 6 divided by the retainer insertion hole 7, a provisional-retaining projection 11 is formed on an upper end of the front portion 4*a* of the partition wall and projects into the retainer insertion hole 7, and a complete-retaining projection 12 is formed on an upper end of the rear portion 4*b* of the partition wall in generally opposed relation to the provisional-retaining projection 11, as shown in FIGS. 2 and 3. Engagement projection pieces 21 (later described) formed respectively on opposite (right and left) sides of each end of the retainer 2 are engageable with these retaining projections, respectively, so as to retain the retainer 2 in a provisionally-retained position and a completely-retained position.

Figure 4:
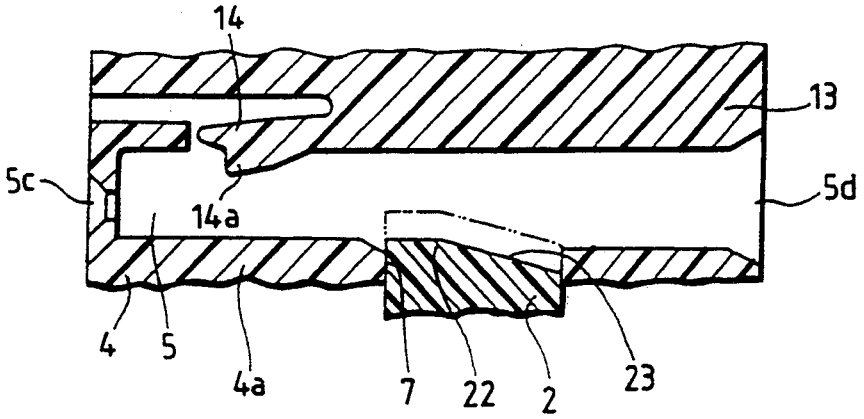
FIG. 4 is a fragmentary cross-sectional view in the provisionally-retained position.

As shown in FIGS. 2 and 4, the terminal receiving chambers 5 are divided by the retainer insertion hole 7, and a small hole 5*c* for inserting a male metal terminal (not shown) is provided at a front end of the terminal receiving chamber 5, and a terminal insertion port 5*d* is provided at a rear end of the terminal receiving chamber. The metal terminal 3 is inserted into the terminal receiving chamber through the terminal insertion port 5*d*. A guide protuberance 13 is formed linearly on an upper surface of the terminal receiving chamber 5 along the direction of insertion of the metal terminal, and a lower surface of guide protuberance 13 guides the insertion of the metal terminal 3. Within the terminal receiving chamber 5, an engagement arm 14 extends rearwardly from the guide protuberance 13 provided at the front portion of the terminal receiving chamber. The engagement arm 14 has an engagement projection 14*a* formed integrally on its lower surface at its distal end and is engaged with the inserted metal terminal 3 (later described) to provisionally retain the metal terminal 3. A stabilizer 35 of the metal terminal 3 (later described) is received in an elongate recess 15 (FIG. 2) formed between the partition wall 4 and the guide protuberance 13. A connector engagement piece 16 for locking an insertion-side connector (not shown) is formed on an upper surface of the housing 1 (see FIG. 1).

The retainer 2 has such a rectangular parallelepiped shape as to be inserted into the retainer insertion hole 7, as shown in FIG. 1 and has terminal receiving chambers 20 that are continuous respectively with the divided lower terminal receiving chambers 5*b* of the housing 1 when the retainer is held in the provisionally and completely retained positions.

The engagement projection pieces 21 are formed on and extend upwardly from the four corners of the upper surface of the retainer 2. Provisionally-retaining pieces 21*a* for engagement with the respective provisional-retaining projections 11 to retain the retainer in the provisionally-retained position, as well as completely-retaining pieces 21*b* for engagement with the respective complete-retaining projections 12 to retain the retainer in the completely-retained position, are formed on the distal ends of the engagement projection pieces 21 (see FIG. 3). Engagement projection pieces 22 are formed on the upper surface of the retainer 2 and are so arranged as to be brought into registry with the upper terminal receiving chambers 5*a*, respectively. In the completely-retained position, each of the projection pieces 22 is projected into the corresponding terminal receiving chambers 5*a* and is engaged in a side recess 33 in the metal terminal 3 (later described) to retain the metal terminal 3. A slanting guide surface 23 is formed on a rear portion of the engagement projection piece 22.

Similar engagement projection pieces 22 are also provided respectively in the terminal receiving chambers 20 and are adapted to be projected respectively into the corresponding lower terminal receiving chambers 5*b*.

Figure 5:
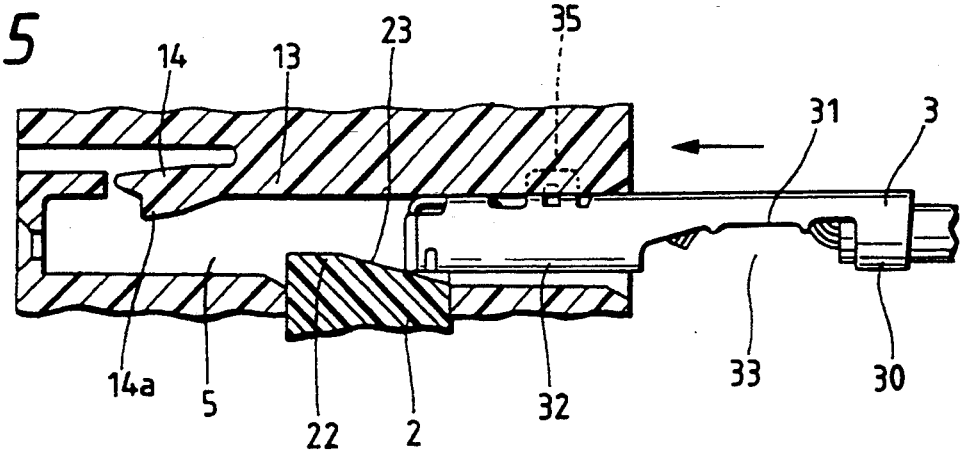
FIG. 5 is a fragmentary cross-sectional view explanatory of the operation.

As shown in FIGS. 1 and 5, the metal terminal 3 has at its rear portion an insulation barrel 30 compressively clamping a sheath of the wire W, and a conductor of the wire W is compressively clamped by a wire barrel 31 of the metal terminal, thus firmly connecting the metal terminal to the wire. The metal terminal further has at its front portion a tubular contact portion 32 into which the male metal terminal is inserted. The side recess 33 is formed in the lower side of the metal terminal and is disposed between the insulation barrel 30 and the contact portion 32. An engagement hole 34 with which the engagement projection 14*a* is adapted to be engaged is formed in the upper surface of the contact portion 32, and the stabilizer 35 for being received in the elongate recess 15 is formed upright integrally on the contact portion and is disposed adjacent one side of the engagement hole.

The operation of this embodiment of the above construction will now be described. Although explanation will be given with respect to the upper terminal receiving chambers 5*a*, the operation with respect to the lower terminal receiving chambers 5*b* is the same, and therefore explanation thereof will be omitted.

Figure 6:
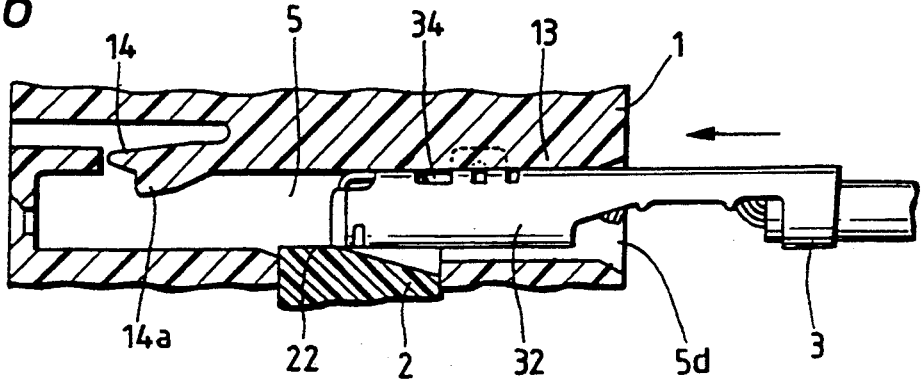
FIG. 6 is a fragmentary cross-sectional view explanatory of the operation.
Figure 7:
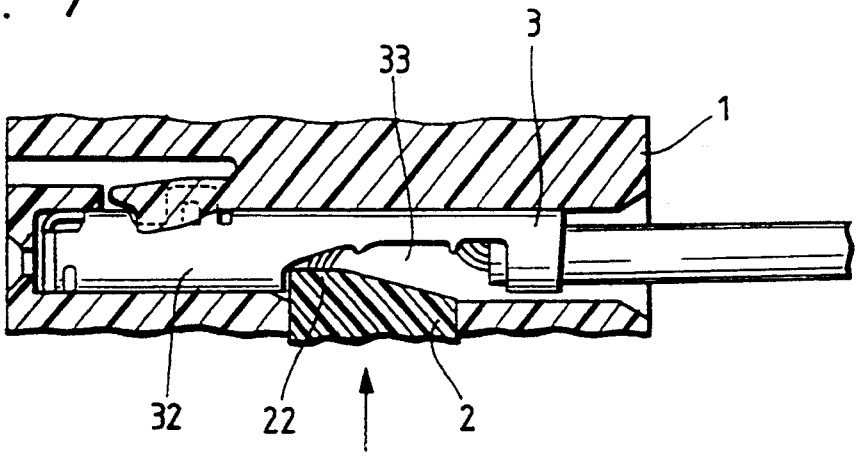
FIG. 7 is a fragmentary cross-sectional view explanatory of the operation.
Figure 8:
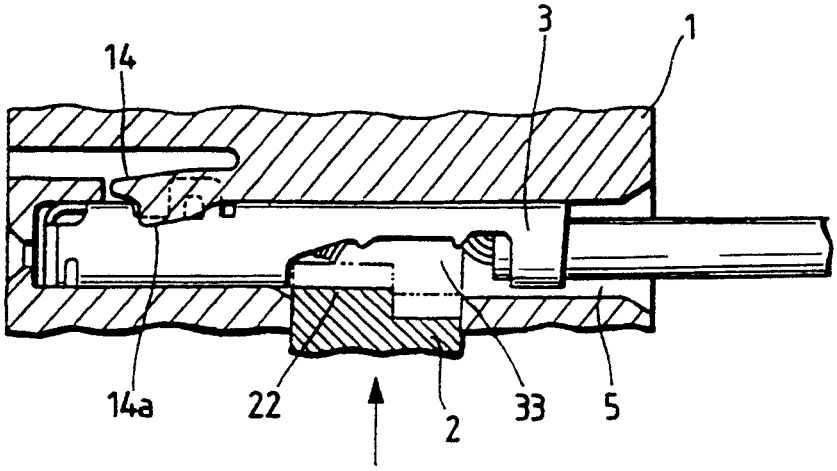
FIG. 8 (PRIOR ART)
FIG. 8 is a fragmentary cross-sectional view showing a conventional example.
Figure 9:
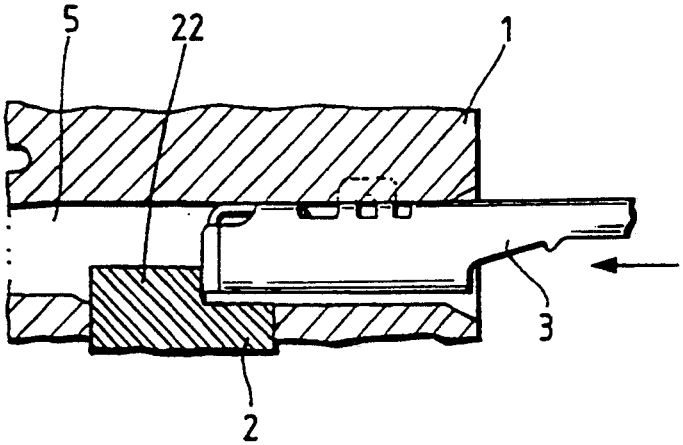
FIG. 9 (PRIOR ART)
FIG. 9 is a fragmentary cross-sectional view showing a problem with the conventional example.

The retainer 2 is held in the provisionally-retained position, as indicated by solid lines in FIG. 3, where the provisionally-retaining pieces 21*a* of the engagement projection pieces 21 are engaged respectively with the provisional-retaining projections 11. At this time, the engagement projection pieces 22 shown in FIG. 6 are disposed in the provisionally-retained position where they are retracted respectively from the upper terminal receiving chambers 5*a*, and in this condition the metal terminals 3 can be inserted. When the metal terminal 3 is inserted through the terminal insertion port 5*d*, the contact portion 32 of the metal terminal 3 is guided by the guide protuberance 13, and when the metal terminal is further inserted, the metal terminal flexes the engagement arm 14 upwardly in sliding contact therewith, and the engagement projection 14*a* is fitted in the engagement hole 34. As a result, the metal terminal 3 is primarily retained within the housing 1 as shown in FIG. 8. Then, when the retainer 2 is urged into the completely-retained position within the housing 1, the engagement projection pieces 22 are fitted respectively in the side recesses 33 of the metal terminals 3. Therefore, the engagement of the engagement projection piece with the contact portion 32 prevents the withdrawal of the metal terminal 3, and the metal terminal 3 is held in a secondarily-retained condition shown in FIG. 7. In this condition, the completely-retaining pieces 21*b* of the retainer 2 are engaged with the complete-retaining projections 12, respectively.

If the retainer 2 has already been pushed into the completely-retained position before inserting the metal terminal 3, the completely-retaining pieces 21*b* are engaged with the complete-retaining projections 12, respectively, as indicated by a dots-and-dash line in FIG. 3, and the engagement projection pieces 22 are received in the respective terminal receiving chambers 5 as shown in FIG. 5. In this condition, when the metal terminal 3 is inserted, the front end of the contact portion 32 of the metal terminal 3 is brought into engagement with the slanting guide surface 23. A space between the guide protuberance 13 and the slanting guide surface 23 is tapering within the terminal receiving chamber 5, and therefore when the metal terminal 3 is further pushed, the contact portion 32 pushes the slanting guide surface 23 in a horizontal direction. A vertical component force of the stress applied to the slanting guide surface 23 overcomes the force of engagement between the complete-retaining projections 12 and the completely-retaining pieces 21*b*, thereby releasing this engagement. Therefore, the retainer 2 is forced back to the provisionally-retained position where the engagement projection pieces 22 are retracted from the terminal receiving chambers 5, respectively. This condition is shown in FIG. 6. The metal terminal 3 is further inserted, and the engagement projection 14*a* of the engagement arm 14 is engaged in the engagement hole 34 in the metal terminal 3, thereby provisionally retaining the metal terminal. With the above operation, the terminal insertion operation is restored to the normal process, and when the retainer 2 thus forced back to the provisionally-retained position is again pushed in, the retainer is completely retained to achieve the secondary retaining.

As described above, in this embodiment, even if the retainer 2 is accidentally pushed into the completely-retained position, the terminal insertion operation can be carried out by the normal operation, that is, by inserting the metal terminal 3 into the terminal receiving chamber 5. Therefore, in contrast with the prior art, it is not necessary to effect the terminal insertion operation after confirming that the retainer is disposed in the provisionally-retained position, and therefore the terminal insertion operation can be carried out quickly.

Furthermore, with respect to the connector of a small size in which the force of engagement between the completely-retaining projection 12 and the complete-retaining piece 21*b* is small, such a connector may be transferred to the terminal insertion step, with the retainer 2 retained not in the provisionally-retained position but in the completely-retained position. By doing so, the retainer 2 is not extended from the housing 1, but is completely received in the housing, thereby reducing the apparent volume, which facilitates the transfer of the connector to the terminal insertion step.

In this embodiment, although the connector having the upper and lower terminal receiving chambers whose number is twelve in all has been described, the number of the terminal receiving chambers is not limited to any specified number. Furthermore, the metal terminals are not limited to one kind, and therefore the connector may be of a hybrid type for connecting many kinds of metal terminals.

In this embodiment, although the slanting guide surface 23 is formed integrally on the rear portion of the engagement projection piece 22, this guide surface does not always need to be provided integrally therewith, and guide surface 23 may be formed by a separate member provided on the rear portion of the engagement projection piece 22. Any slanting guide surface is acceptable in so far as it can urge the retainer back to the provisionally-retained position from the completely-retained position by the inserted metal terminal 3.

In this embodiment, although the connector for retaining the female metal terminals 3 has been described, the invention can be applied to the type of connector for retaining male metal terminals. As described above, in the present invention, even if the retainer is already retained in the completely-retained position before inserting the metal terminal, the retainer can be returned to the provisionally-retained position merely by inserting the metal terminal, thus facilitating the terminal insertion operation.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A connector comprising:

a housing having a plurality of terminal receiving chambers for receiving a corresponding plurality of terminals; and a retainer insertable into a retainer insertion hole in said housing, said retainer insertion hole dividing said housing into a first portion and a second portion, wherein said first portion comprises a provisional retaining projection and said second portion comprises a complete retaining projection, said retainer comprising at least one insertion hole engagement projection having a first engagement projection piece and a second engagement projection piece engageable with said provisional retaining projection and said complete retaining projection, respectively, thereby retaining said retainer in a provisionally-retained position and a completely-retained position, respectively, said retainer further comprising means for shifting said retainer from said completely-retained position to said provisionally-retained position if said retainer is in said completely-retained position before one of said terminals is inserted into a corresponding one of said terminal receiving chambers, said shifting means comprising at least one terminal engagement projection piece engageable with a corresponding at least one of said terminals, said at least one terminal engagement projection piece protruding into a corresponding at least one of said terminal receiving chambers when said retainer is in said completely-retained position, wherein said at least one terminal engagement projection piece comprises a slanting guide surface, wherein if said retainer is in said completely-retained position before one of said terminals is inserted into a corresponding one of said terminal receiving chambers, said one of said terminals engages said slanting guide surface and urges said retainer into said provisionally-retained position during terminal insertion.

2. A connector as claimed in claim 1, wherein said retainer comprises a pair of insertion hole engagement projections and a plurality of terminal engagement projection pieces disposed between said pair of insertion hole engagement projections.

3. A connector as claimed in claim 1, wherein said slanting guide surface is integral with said terminal engagement piece.

4. A connector including a housing having a plurality of terminal receiving chambers for receiving a corresponding plurality of terminals and a retainer insertable into a retainer insertion hole in said housing, said retainer insertion hole dividing said housing into a first portion and a second portion, wherein said first portion comprises a provisional retaining projection and said second portion comprises a complete retaining projection, said retainer comprising:

at least one insertion hole engagement projection having a first engagement projection piece and a second engagement projection piece engageable with said provisional retaining projection and said complete retaining projection, respectively, thereby retaining said retainer in a provisionally-retained position and a completely-retained position, respectively; and at least one terminal engagement projection piece engageable with a corresponding at least one of said terminals, said at least one terminal engagement projection piece protruding into a corresponding at least one of said terminal receiving chambers when said retainer is in said completely-retained position, wherein said at least one terminal engagement projection piece comprises a slanting guide surface, wherein if said retainer is in said completely-retained position before one of said terminals is inserted into a corresponding one of said terminal receiving chambers, said one of said terminals engages said slanting guide surface and urges said retainer into said provisionally-retained position during terminal insertion.

5. A connector as claimed in claim 4, wherein said retainer comprises a pair of insertion hole engagement projections and a plurality of terminal engagement projection pieces disposed between said pair of insertion hole engagement projections.

6. A connector as claimed in claim 4, wherein each of said terminal receiving chambers comprises an engagement arm having an engagement projection engageable with a respective one of said terminals, said engagement projection extending into a respective one of said terminal receiving chambers, wherein said engagement arm is disposed downstream of said at least one terminal engagement projection piece in a terminal insertion direction.

7. A connector as claimed in claim 4, wherein said retainer further comprises a slot directly between said first engagement projection piece and said second engagement projection piece such that the first and second engagement projection pieces oppose each other on opposite sides of the slot.

8. A connector comprising a housing having terminal receiving chambers for respectively receiving metal terminals inserted from their respective rear portions; and a retainer inserted into a retainer insertion hole formed in one side of said housing, said retainer being retained in a provisionally-retained position where said retainer does not prevent insertion and withdrawal of the metal terminals and in a completely-retained position where said retainer is engaged with the inserted metal terminals to prevent the withdrawal of the metal terminals, wherein said retainer comprises engagement projection pieces that intrude respectively into said terminal receiving chambers in-said completely-retained position and a slanting guide surface formed on a rear portion of each of said engagement projection pieces, said slanting guide surface enabling the inserted metal terminal to push said retainer back to said provisionally-retained position from said completely-retained position during terminal insertion.

* * * * *